US007657218B2

(12) United States Patent
Maruyama et al.

(10) Patent No.: US 7,657,218 B2
(45) Date of Patent: Feb. 2, 2010

(54) GLOSS PROVIDING SHEET AND IMAGE FORMATION APPARATUS

(75) Inventors: Hitoshi Maruyama, Tokyo (JP); Kei Yasutomi, Kanagawa (JP); Eisaku Murakami, Tokyo (JP); Reki Nakamura, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 343 days.

(21) Appl. No.: 11/892,227

(22) Filed: Aug. 21, 2007

(65) Prior Publication Data

US 2008/0056785 A1 Mar. 6, 2008

(30) Foreign Application Priority Data

Aug. 22, 2006 (JP) ..... 2006-225119
Sep. 8, 2006 (JP) ..... 2006-243995

(51) Int. Cl.
*G03G 15/20* (2006.01)

(52) U.S. Cl. ..... 399/341; 399/342

(58) Field of Classification Search ..... 399/341, 399/342; 430/97
See application file for complete search history.

(56) References Cited

U.S. PATENT DOCUMENTS 5,126,797 A * 6/1992 Forest et al. ..... 399/342
5,441,838 A * 8/1995 Pane ..... 430/97
2007/0164505 A1 7/2007 Ishibashi et al.

FOREIGN PATENT DOCUMENTS

| | | |
|---|---|---|
| JP | 61-122665 | 6/1986 |
| JP | 61-122666 | 6/1986 |
| JP | 63-092965 | 4/1988 |
| JP | 63-149683 | 6/1988 |
| JP | 04-342277 | 11/1992 |
| JP | 04-369677 | 12/1992 |
| JP | 09/150456 | 6/1997 |
| JP | 2000-136968 | 5/2000 |
| JP | 3213969 | 7/2001 |
| JP | 2002-091048 | 3/2002 |
| JP | 2002-206972 | 7/2002 |
| JP | 2002-372882 | 12/2002 |
| JP | 2003-076096 | 3/2003 |

* cited by examiner

*Primary Examiner*—Hoang Ngo
(74) *Attorney, Agent, or Firm*—Harness, Dickey & Pierce, P.L.C.

(57) ABSTRACT

A disclosed gloss-providing sheet for providing high gloss to a toner image on a recording material by being placed on a toner image surface of the recording material, heated so as to fuse toner, and then separated from the recording material after the toner is cooled and solidified includes: a notification portion that changes a visual state thereof when a temperature of the gloss-providing sheet becomes equal to or lower than a glass transition temperature of the toner.

14 Claims, 8 Drawing Sheets

GLOSS PROVIDING SHEET AND IMAGE FORMATION APPARATUS

BACKGROUND OF THE INVENTION

1. Field of the Invention

The present invention relates to a gloss-providing sheet for providing high gloss to a toner image on a recording material in which the gloss-providing sheet is placed on a toner image surface of the recording material such as paper and is heated so as to fuse toner, and then the gloss-providing sheet is separated from the recording material after the toner is cooled and solidified. Further, the present invention relates an image formation apparatus such as a copying machine, printer, facsimile machine, multi-function device thereof, and the like using such a gloss-providing sheet and more particularly to an image formation apparatus employing electrophotography.

2. Description of the Related Art

In an image formation apparatus employing electrophotography, it has been difficult to form a uniform high-gloss image as created by silver halide photography. The high-gloss image has a smooth surface and it is necessary to sufficiently fuse toner having a particle size not less than 5 μm so as to obtain such a surface. However, when the toner is sufficiently fused, a fixing method using a conventional fixing roller and a fixing belt poses problems such as hot offset where the toner is adhered to the fixing roller and winding where the recording material is wound around the fixing roller. Further, there is another problem in that while the toner is fused at high temperature, when a toner surface is separated from the fixing roller or the fixing belt, a surface shape is deformed and a smooth high-gloss image is not provided.

Patent Documents 1 and 2 disclose methods for obtaining a uniform high-gloss image so as to solve the above-mentioned problems. In techniques disclosed in Patent Documents 1 and 2, the gloss-providing sheet is placed on the toner image fixed on the recording material and then heated and pressurized again, so that the toner image is sufficiently refused and the gloss-providing sheet is separated after the toner is cooled and solidified, thereby obtaining high gloss. An important point here is to separate the gloss-providing sheet after the toner is cooled and solidified. In accordance with this, a shape of a smooth sheet surface is transferred to the toner surface and the toner surface becomes smooth, so that it is possible to obtain a uniform high-gloss image.

Patent Document 3 discloses a more advanced technique. In the technique disclosed in Patent Document 3, a heating portion, cooling portion, and separation portion are disposed on a circumference of an endless belt. The heating portion sufficiently fuses the toner, the cooling portion subsequently cools and solidifies the toner so as to transfer a smooth surface shape of the endless belt to the toner, and then the separation portion performs separation, thereby obtaining a uniform high-gloss image.

It is possible to increase gloss of a solid portion by sufficiently fusing the toner and having a smooth surface. However, on a halftone made of dots or lines, it is impossible to form a uniform high-gloss image since fields where the toner is placed and where the toner is not placed are mixed and convexity and concavity are inevitably formed on the surface.

In view of this, as disclosed in Patent Document 4, there is a method employing a recording material in which a layer coated with thermoplastic resin is disposed on the surface and the toner is embedded in the coated layer, so that a smooth surface is obtained.

At convenience stores and the like, there are disposed products as digital camera printers capable of forming a uniform high-gloss image as created by silver halide photography in combination with the technique disclosed in Patent Document 3 and the technique disclosed in Patent Document 4.

Further, a large number of electrophotographic image formation apparatuses including a laminating function have been proposed (refer to Patent Document 5, for example). However, these apparatuses have little practical use since any of such apparatuses requires a large-scale device and some users do not prefer laminated images, so that such apparatuses have been hardly used.

In an image formation apparatus employing electrophotography, it has been difficult to form a uniform high-gloss image as created by silver halide photography largely because toner having a particle size of not less than 5 μm is used when attempting to have a smooth surface for an image. It is possible to increase gloss of a solid portion by sufficiently fusing the toner and having a smooth surface. However, on a halftone made of dots or lines, it is impossible to form uniformly high-gloss since fields where the toner is placed and where the toner is not placed are mixed and convexity and concavity are inevitably formed on the surface.

In view of this, as disclosed in Patent Document 4, a recording material has been used such that a layer coated with thermoplastic resin is disposed on the surface and the toner is embedded in the coated layer, so that a smooth surface is obtained. However, even when this recording material is used, a fixing method for a conventional fixing device using a fixing roller and a fixing belt poses problems such as hot offset where the toner is adhered to the fixing roller when the toner is sufficiently fused and winding where the recording material is wound around the fixing roller. Further, there is another problem in that while the toner is fused at high temperature, when a toner surface is separated from the fixing roller or the fixing belt, a surface shape is deformed and a smooth high-gloss image is not provided.

In view of this, as disclosed in Patent Document 6, there is proposed a fixing device in which a heating portion, cooling portion, and separation portion are disposed on a circumference of an endless belt having a smooth high-gloss surface. In the device, the heating portion sufficiently fuses the toner so as to follow the gloss surface, the cooling portion solidifies the toner so as to transfer the gloss surface of the endless belt, and then the separation portion separates the endless belt and the toner surface. In accordance with this, a smooth toner surface is obtained and a smooth high-gloss image is provided as a result.

In fact, this fixing device has been successfully commercialized and-disposed as digital camera printers at convenience stores and the like. However, this method requires a large-scale device, so that there are problems in terms of cost and size.

Further, as disclosed in Patent Documents 5 and 7, a large number of electrophotographic image formation apparatuses including a laminating function have been proposed. However, these apparatuses have little practical use since any of such apparatuses requires a large-scale device and some users do not prefer laminated images, so that such apparatuses have been hardly used.

Patent Document 1: Japanese Laid-Open Patent Application No. 4-31389

Patent Document 2: Japanese Laid-Open Patent Application No. 4-31393

Patent Document 3: Japanese Patent No. 2992711

Patent Document 4: Japanese Laid-Open Patent Application No. 63-92965

Patent Document 5: Japanese Laid-Open Patent Application No. 9-150456

Patent Document 6: Japanese Laid-Open Patent Application No. 2002-91048

Patent Document 7: Japanese Patent No. 3213969

The fixing device as proposed in Patent Document 3 has merits, in which the heating portion, cooling portion, and separation portion are disposed on the circumference of the endless belt. However, the fixing device has problems in that cost is increased, print speed cannot become fast because of the necessity of cooling time, and the belt has life resulting from degradation of the gloss surface of the belt because a structure of the device is different from that of a conventional fixing device.

By contrast, the methods proposed in Patent Documents 1 and 2 in which the sheet is placed become very simple when the recording material to which the gloss-providing sheet is adhered is output and a user separates the gloss-providing sheet since a conventional image formation apparatus is not largely modified. The methods have merits in that it is possible to use the structure of the conventional fixing device at low cost, it is possible to perform output at high speed without having the cooling time for solidifying the toner, and the problem of product life is eliminated by using a disposable gloss-providing sheet or replacing the belt with a new one when the gloss surface is degraded.

However, when the gloss-providing sheet is separated, if the user erroneously separates the sheet while the toner is not sufficiently cooled and solidified, a smooth surface of the toner is deformed and a uniform high-gloss image is not obtained. Accordingly, the user is required to separate the sheet after sufficient cooling, so that it is necessary to notify the user of a time when the user is allowed to separate the sheet.

Further, in order to solve the problem that while the toner is fused at high temperature, when the toner surface is separated from the fixing roller or the fixing belt, the surface shape is deformed and a smooth high-gloss image is not provided, as disclosed in Patent Document 6, it is necessary to cool and solidify the toner before separating the toner surface after the toner is fused to follow the smooth high-gloss surface.

SUMMARY OF THE INVENTION

It is a general object of the present invention to provide an improved and useful gloss-providing sheet in which the above-mentioned problems are eliminated.

A more specific object of the present invention is to provide a gloss-providing sheet for providing high gloss to a toner image on a recording material in which the gloss-providing sheet is placed on a toner image surface of the recording material and is heated so as to fuse toner, and then the gloss-providing sheet is separated from the recording material after the toner is cooled and solidified, so that the gloss-providing sheet enables the user to readily confirm that the toner on the recording material is sufficiently cooled and solidified and separation from the recording material is allowed.

It is also a general object of the present invention to provide an improved and useful image formation apparatus in which the above-mentioned problems are eliminated.

Another specific object of the present invention is to provide an image formation apparatus that can provide a smooth high-gloss image using a practical unit which involves no major change of design without requiring a high-cost and large-scale device as disclosed in Patent Document 6 or generating the problems such as hot offset and winding.

According to one aspect of the present invention, there is disposed a gloss-providing sheet for providing high gloss to a toner image on a recording material by being placed on a toner image surface of the recording material such as paper, heated so as to fuse toner, and then separated from the recording material after the toner is cooled and solidified, the gloss-providing sheet comprising: a notification portion that changes a visual state thereof when a temperature of the gloss-providing sheet becomes equal to or lower than a glass transition temperature of the toner.

According to another aspect of the present invention, in the above-mentioned gloss-providing sheet, the notification portion develops color when the temperature of the gloss-providing sheet becomes equal to or lower than a glass transition temperature of the toner.

When the temperature of the gloss-providing sheet becomes equal to or lower than the glass transition temperature of the toner, the notification portion of the gloss-providing sheet develops color. The notification portion is for notifying through color development that the gloss-providing sheet may be separated from the recording material. The notification portion may be in an entire sheet or a portion of the sheet.

According to another aspect of the present invention, in the above-mentioned gloss-providing sheet, the notification portion eliminates color when the temperature of the gloss-providing sheet becomes equal to or lower than the glass transition temperature of the toner.

When the temperature of the gloss-providing sheet becomes equal to or lower than the glass transition temperature of the toner, the notification portion of the gloss-providing sheet eliminates color. The notification portion is for notifying through color elimination that the gloss-providing sheet may be separated from the recording material. The notification portion may be in the entire sheet or a portion of the sheet.

According to another aspect of the present invention, in the above-mentioned gloss-providing sheet, the notification portion changes color when the temperature of the gloss-providing sheet becomes equal to or lower than the glass transition temperature of the toner.

When the temperature of the gloss-providing sheet becomes equal to or lower than the glass transition temperature of the toner, the notification portion of the gloss-providing sheet changes color. The notification portion is for notifying through color change that the gloss-providing sheet may be separated from the recording material. The notification portion may be in the entire sheet or a portion of the sheet.

According to another aspect of the present invention, in the above-mentioned gloss-providing sheet, a character string is displayed on the notification portion. A message displayed on the notification portion notifies information on separation of the gloss-providing sheet.

According to another aspect of the present invention, in the above-mentioned gloss-providing sheet, the notification portion is changed when the temperature of the gloss-providing sheet becomes lower than the glass transition temperature of toner by 20° C. or more. When the temperature of the gloss-providing sheet becomes lower than the glass transition temperature of toner by 20° C. or more, the notification portion is changed so as to develop color, eliminate color, or change color.

According to another aspect of the present invention, in the above-mentioned gloss-providing sheet, the notification portion is constructed using microencapsulated pigment with reversible thermochromic properties. The microencapsulated pigment with reversible thermochromic properties contain leuco dye, developer, and desensitizer in microcapsules.

According to another aspect of the present invention, there is disposed an image formation apparatus for forming a toner image on a recording material such as paper, placing the above-mentioned gloss-providing sheet on a toner image surface of the recording material, heating so as to fuse toner to fix the toner image on the recording material, and ejecting the gloss-providing sheet and the recording material. After the notification portion develops color, eliminates color, or changes color, the gloss-providing sheet is separated from the ejected recording material.

According to the present invention, when the temperature of the gloss-providing sheet becomes equal to or lower than the glass transition temperature of the toner, the notification portion of the gloss-providing sheet develops color, so that the user is notified of an appropriate time when it is possible to separate the gloss-providing sheet from the recording material. And, it is possible to separate the gloss-providing sheet after recognizing that the toner is sufficiently cooled and solidified and to obtain a uniform high-gloss image.

According to the present invention, when the temperature of the gloss-providing sheet becomes equal to or lower than the glass transition temperature of the toner, the notification portion of the gloss-providing sheet eliminates color, so that the user is notified of an appropriate time when it is possible to separate the gloss-providing sheet from the recording material. And, it is possible to separate the gloss-providing sheet after recognizing that the toner is sufficiently cooled and solidified and to obtain a uniform high-gloss image.

According to the present invention, when the temperature of the gloss-providing sheet becomes equal to or lower than the glass transition temperature of the toner, the notification portion of the gloss-providing sheet changes color, so that the user is notified of an appropriate time when it is possible to separate the gloss-providing sheet from the recording material. And, it is possible to separate the gloss-providing sheet after recognizing that the toner is sufficiently cooled and solidified and to obtain a uniform high-gloss image.

According to the present invention, the message displayed on the notification portion clearly notifies information on separation of the gloss-providing sheet, so that it is possible to separate the gloss-providing sheet from the recording material based on the information without making an erroneous judgment.

According to the present invention, when the temperature of the gloss-providing sheet becomes lower than the glass transition temperature of toner by 20° C. or more, the notification portion is changed so as to develop color, eliminate color, or change color, so that it is possible to separate the gloss-providing sheet after recognizing that the toner is sufficiently cooled and solidified.

According to the present invention, the notification portion is constructed using microencapsulated pigment with reversible thermochromic properties, so that it is possible to appropriately and securely change the notification portion so as to develop color, eliminate color, or change color.

According to the present invention, after the notification portion develops color, eliminates color, or changes color, the gloss-providing sheet is separated from the ejected recording material, so that it is possible to separate the gloss-providing sheet after recognizing that the toner is sufficiently cooled and solidified and to obtain a uniform high-gloss image. A problem of product life is eliminated by using a disposable gloss-providing sheet or replacing the belt with a new one when the gloss surface is degraded.

Moreover, according to yet another aspect of the present invention, there is provided an image formation apparatus for allowing a recording material such as paper having a toner image on an image surface thereof to pass through a first fixing device so as to fuse toner to fix the toner image on the recording material, and ejecting the recording material to a paper ejection tray, aftertreatment device, and the like, the image formation apparatus comprising: a sheet cassette for storing a gloss-providing sheet; and a second fixing device fusing the toner again and applying the gloss-providing sheet to the recording material, after the gloss-providing sheet which has been fed from the sheet cassette is placed on the image surface of the recording material having the toner image fixed by the first fixing device, by passing the recording material and the gloss-providing sheet therethrough.

The recording material having the toner image on the image surface is passed through the first fixing device so as to fuse toner once, the toner image is fixed on the recording material, and then the gloss-providing sheet fed from the sheet cassette is placed on the image surface of the recording material after the fixing in the first fixing device. The recording material on which the gloss-providing sheet is placed is passed through the second fixing device so as to fuse the toner again and the gloss-providing sheet is adhered. The recording material and the gloss-providing sheet are ejected while they are adhered to each other or after the gloss-providing sheet is separated thereafter.

The gloss-providing sheet may be coated with mold release agent on a surface to be placed on the image surface of the recording material. The image formation apparatus includes: a first image formation mode for ejecting the recording material only through the first fixing device; and a second image formation mode for ejecting the recording material through both first fixing device and second fixing device, for example, so that it is possible to select and use a desired image formation mode as appropriate.

Further, in the image formation apparatus, operation of the first fixing device and the second fixing device may be performed using a common and single fixing device, the recording material is passed through the common and single fixing device in a first passing, the recording material after the fixing is passed through a conveying path for duplex image formation, the gloss-providing sheet is placed on the recording material, and the recording material and the gloss-providing sheet are passed through the common and single fixing device in a second passing. In this case, the image formation apparatus may include: a switching member for switching a conveying course of the recording material depending on a duplex image formation mode or a high-gloss image formation mode on the conveying path for duplex image formation.

In the image formation apparatus, the gloss-providing sheet placed on the recording material and passed through the second fixing device may be storable in the sheet cassette after being separated from the recording material.

According to the present invention, after the toner is fused once and the toner image is fixed on the recording material, the toner is fused again and the gloss-providing sheet is adhered to the recording material, so that it is possible to sufficiently fuse the toner at high temperature without generating problems such as hot offset and winding. A surface of the fused toner is solidified in accordance with a smooth sheet surface of the gloss-providing sheet, so that it is possible to obtain a uniformly smooth high-gloss image. Further, it is possible to use a structure of a general fixing device that has been conventionally used, so that it is possible to provide a practical apparatus without requiring a high-cost and large-scale device or major change of design. For example, when the recording material is ejected while the gloss-providing sheet is adhered to the recording material, it is possible to perform output at high speed without having cooling time for solidifying the toner.

According to the present invention, the gloss-providing sheet is coated with mold release agent on the surface to be placed on the image surface of the recording material. Thus, it is possible to reduce adhesion of the toner to the gloss-providing sheet using the mold release agent and to prevent reduction of image quality when the gloss-providing sheet is separated from the recording material without adhering the toner to the gloss-providing sheet.

According to the present invention, the image formation apparatus includes: the first image formation mode for ejecting the recording material only through the first fixing device; and the second image formation mode for ejecting the recording material through both first fixing device and second fixing device. Thus, it is possible to selectively output both low-gloss image and high-gloss image using a single image formation apparatus and increase applications of the image formation apparatus.

According to the present invention, operation of the first fixing device and the second fixing device is performed using a common and single fixing device, so that it is possible to downsize the image formation apparatus with a single fixing device and to reduce cost. Moreover, the recording material passed through the common and single fixing device in the first passing is passed through the conveying path for duplex image formation, the gloss-providing sheet is placed on the recording material, and then the recording material and the gloss-providing sheet are passed through the fixing device in the second passing. Thus, it is possible to obtain a uniformly smooth high-gloss image using a conventional duplex image formation apparatus without requiring major change of design.

According to the present invention, the image formation apparatus includes: the switching member for switching the conveying course of the recording material depending on the duplex image formation mode or the high-gloss image formation mode on the conveying path for duplex image formation included in a duplex unit, for example. Thus, by setting the high-gloss image formation mode in which the recording material is passed through the fixing device in the first passing and refeeding is enabled without reversing the recording material after the fixing of the toner, it is possible arrange a feeding direction of the gloss-providing sheet and a feeding direction of the recording material in the same direction and to dispose the sheet cassette above the recording material storage cassette on the same side. As a result, it is possible to densely arrange elements and downsize the image formation apparatus.

According to the present invention, the gloss-providing sheet is storable after use in the sheet cassette. Thus, it is possible to reduce cost without wasting the gloss-providing sheet and meet the social demand of resource protection in recent years.

Other objects, features and advantage of the present invention will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

Figure 1:
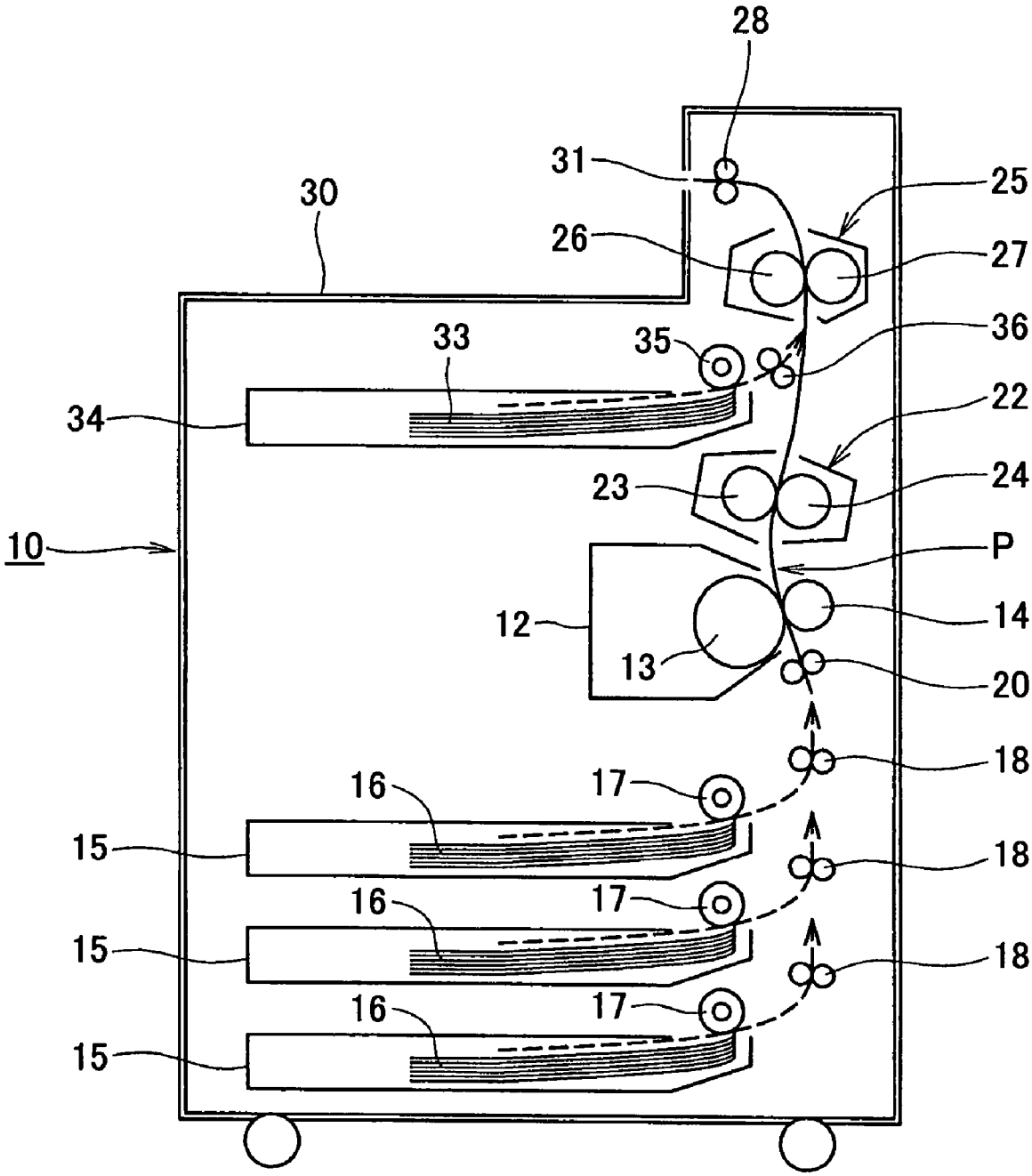
FIG. 1 is a schematic configuration diagram showing an entire portion of an electrophotographic image formation apparatus using a gloss-providing sheet according to the present invention.

FIG. 1 is a schematic configuration diagram showing an entire portion of an electrophotographic image formation apparatus using a gloss-providing sheet according to the present invention.

An image formation apparatus body referenced at 10 includes a process unit 12 detachably disposed on a middle portion. A photoconductor 13 having a drum-like shape is rotatably disposed on the process unit 12 and a charging unit, development unit, and the like (not shown in the drawings) are disposed on a periphery of the photoconductor 13. Further, in the vicinity of the process unit 12, a writing unit (not shown in the drawings) is disposed. A transfer device 14 having a roller shape is pressed on the photoconductor 13 of the process unit 12, the transfer device 14 being disposed so as to face the photoconductor 13 across a recording material conveying path P, thereby forming a transfer nip.

In the image formation apparatus body 10, recording material storage cassettes 15 are each detachably disposed in three stages below the process unit 12. Recording materials 16 having different sizes are loaded and stored in each recording material storage cassette 15. In general, paper is used as the recording material 16. Each recording material storage cassette 15 includes a paper feed roller 17 for feeding the stored recording material 16 and a pair of conveying rollers 18 for guiding the supplied recording material 16 to the recording material conveying path P and conveying the recording material 16 upward.

On the recording material conveying path P extending from a lower portion to an upper portion on a right side in the image formation apparatus body 10, a pair of register rollers 20 is disposed before the transfer nip and a first fixing device 22 is disposed after passing through the transfer nip. The first fixing device 22 presses a first pressure roller 24 on a first heating roller 23 including a heater therein through biasing using a biasing member not shown in the drawings, thereby forming a first fixing nip.

Along with a shape of the recording material conveying path P, a second fixing device 25 is disposed downstream relative to the first fixing device 22. In the same manner as in the first fixing device 22, the second fixing device 25 presses a second pressure roller 27 on a second heating roller 26 including a heater therein through biasing using a biasing member not shown in the drawings, thereby forming a second fixing nip. Further, a pair of paper ejection rollers 28 is disposed downstream relative to the second fixing device 25 and a paper ejection outlet 31 is subsequently disposed for a paper ejection stack portion 30 on the image formation apparatus body 10.

In the recording material conveying path P between the first fixing device 22 and the second fixing device 25, a gloss-providing sheet 33 is allowed to join a flow such that the gloss-providing sheet 33 is placed on an image surface of the recording material 16. The gloss-providing sheet 33 has a smooth surface and is loaded and stored in a sheet cassette 34 detachably disposed above the process unit 12. The gloss-providing sheet 33 is fed by a feeding roller 35, conveyed by a pair of conveying rollers 36, and guided to the recording material conveying path P in accordance with a time when the recording material 16 is conveyed in the recording material conveying path P.

When the image formation apparatus in this example forms a low-gloss image on the recording material 16, through a signal from a host, operation from an operation display panel not shown in the drawings, or the like, a first image formation mode is set in which the recording material 16 after formation of a toner image is ejected only through the first fixing device 22. Then, the process unit 12 is driven and the photoconductor 13 is rotated in the counterclockwise direction so as to form a toner image on the photoconductor 13 by performing charging, writing, and development using process devices including a charge device, writing device, development device, and the like. On the other hand, one of the paper feed rollers 17 is selectively driven, the recording material 16 is fed from the corresponding recording material storage cassette 15 and is guided to the recording material conveying path P, the recording material 16 is conveyed by the pair of conveying rollers 18, and a tip of the recording material 16 is brought into abutment with the pair of register rollers 20 and the recording material 16 is stopped.

Thereafter, the pair of register rollers 20 is rotated in accordance with the toner image formed on the rotating photoconductor 13 as mentioned above and the recording material 16 is fed to the transfer nip so as to transfer the toner image on the photoconductor 13 to the recording material 16 using the transfer device 14. The recording material having the toner image on the image surface after the transfer of the toner image is guided to the first fixing device 22 through the recording material conveying path P and toner is fused by applying heat and pressure using the first heating roller 23 and the first pressure roller 24 so as to fix the toner image on the recording material 16.

The recording material 16 after the fixing of the toner image is directly conveyed in the recording material conveying path P and is passed through the second fixing device 25 not in operation, namely, generating no heat. Then, the recording material 16 is ejected from the paper ejection outlet 31 using the pair of paper ejection rollers 28 and is stacked on the paper ejection stack portion 30.

On the other hand, when the image formation apparatus in this example forms a high-gloss image on the recording material 16, through a signal from the host, operation from the operation display panel not shown in the drawings, or the like, a second image formation mode is set in which the recording material 16 after the toner image is formed is ejected through both first fixing device 22 and second fixing device 25. The toner image formed on the photoconductor 13, in the same manner as in the case of forming a low-gloss image, is transferred to the recording material 16 fed from one of the recording material storage cassettes 15. After the toner is fused once and fixed using the first fixing device 22, the gloss-providing sheet 33 fed from the sheet cassette 34 is placed on the image surface of the image-fixed recording material 16 and the recording material 16 is guided to the second fixing device 25. The toner is sufficiently fused again at high temperature by applying heat and pressure using the second heating roller 26 and the second pressure roller 27 so as to adhere the gloss-providing sheet 33 to the recording material 16. Then, the recording material 16 is ejected from the paper ejection outlet 31 using the pair of paper ejection rollers 28 and is stacked on the paper ejection stack portion 30 in the same manner as in the case of forming the low-gloss image.

Thereafter, the gloss-providing sheet 33 is separated after a temperature of the recording material 16 to which the gloss-providing sheet 33 is adhered is lowered such that the toner is solidified.

As mentioned above, in the image formation apparatus of this example, the toner is fused once and the toner image is fixed on the recording material 16, and then the toner is fused again and the gloss-providing sheet 33 is adhered to the recording material 16. Thus, it is possible to sufficiently fuse the toner at high temperature without generating the problems such as hot offset and winding. In the surface of the fused toner, a smooth surface of the gloss-providing sheet 33 is transferred and the toner is solidified in accordance with the smooth sheet surface, so that it is possible to obtain a high-gloss image which is uniformly smooth in a solid portion, halftone portion, and non-image portion. This is more effective when a special recording material is used so as to obtain a smooth image surface by disposing a layer coated with thermoplastic resin on a surface thereof and embedding the toner in the coated layer as disclosed in Patent Document 4 in particular.

Further, it is possible to use a structure of a general fixing device conventionally employed, so that a practical apparatus is provided without requiring a high-cost and large-scale device or major change of design. In particular, when the recording material 16 is ejected while the gloss-providing sheet 33 is adhered to the recording material 16, there is a great advantage in that it is possible to perform output at high speed without having cooling time for solidifying the toner.

Figure 2:
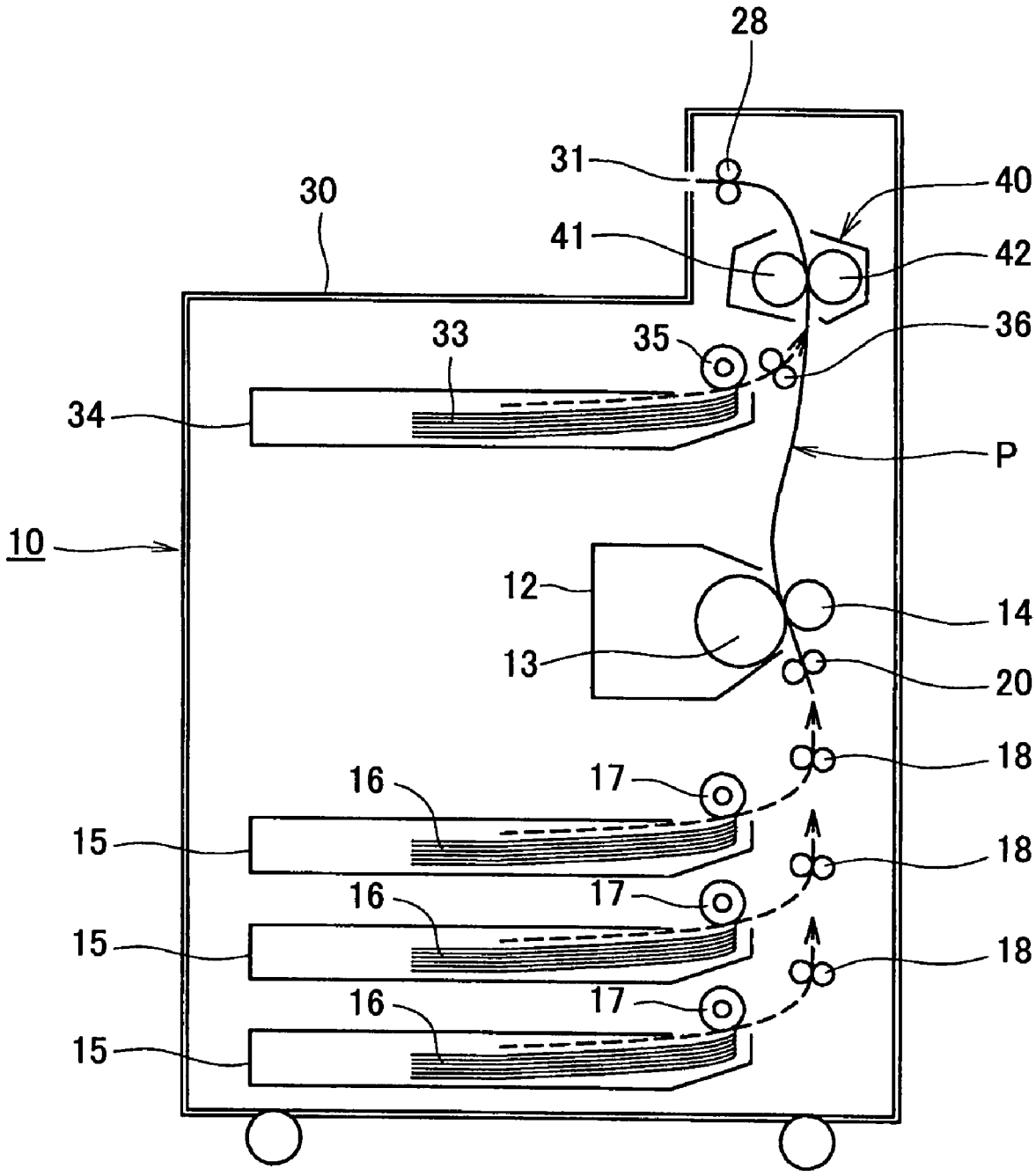
FIG. 2 is another example of a schematic configuration diagram showing an entire portion of an electrophotographic image formation apparatus using a gloss-providing sheet according to the present invention.

FIG. 2 is another example of a schematic configuration diagram showing an entire portion of an electrophotographic image formation apparatus using a gloss-providing sheet according to the present invention.

In this example, the first fixing device 22 of the image formation apparatus shown in FIG. 1 is removed and only a fixing device 40 corresponding to the second fixing device 25 is disposed. And, the same reference numerals as in FIG. 1 are assigned to corresponding elements.

When a low-gloss image is formed on the recording material 16, the recording material 16 after the formation of the toner image is directly guided to the common and single fixing device 40 and fixing is performed by applying heat and pressure using a heating roller 41 and a pressure roller 42. On the other hand, when a high-gloss image is formed, the gloss-providing sheet 33 is placed on the recording material 16 after the formation of the toner image and the recording material 16 is guided to the fixing device 40. Heat and pressure are applied using the heating roller 41 and the pressure roller 42 in the same manner. Then, the recording material 16 is ejected from the paper ejection outlet 31 using the pair of paper ejection rollers 28 and is stacked on the paper ejection stack portion 30.

Figure 3:
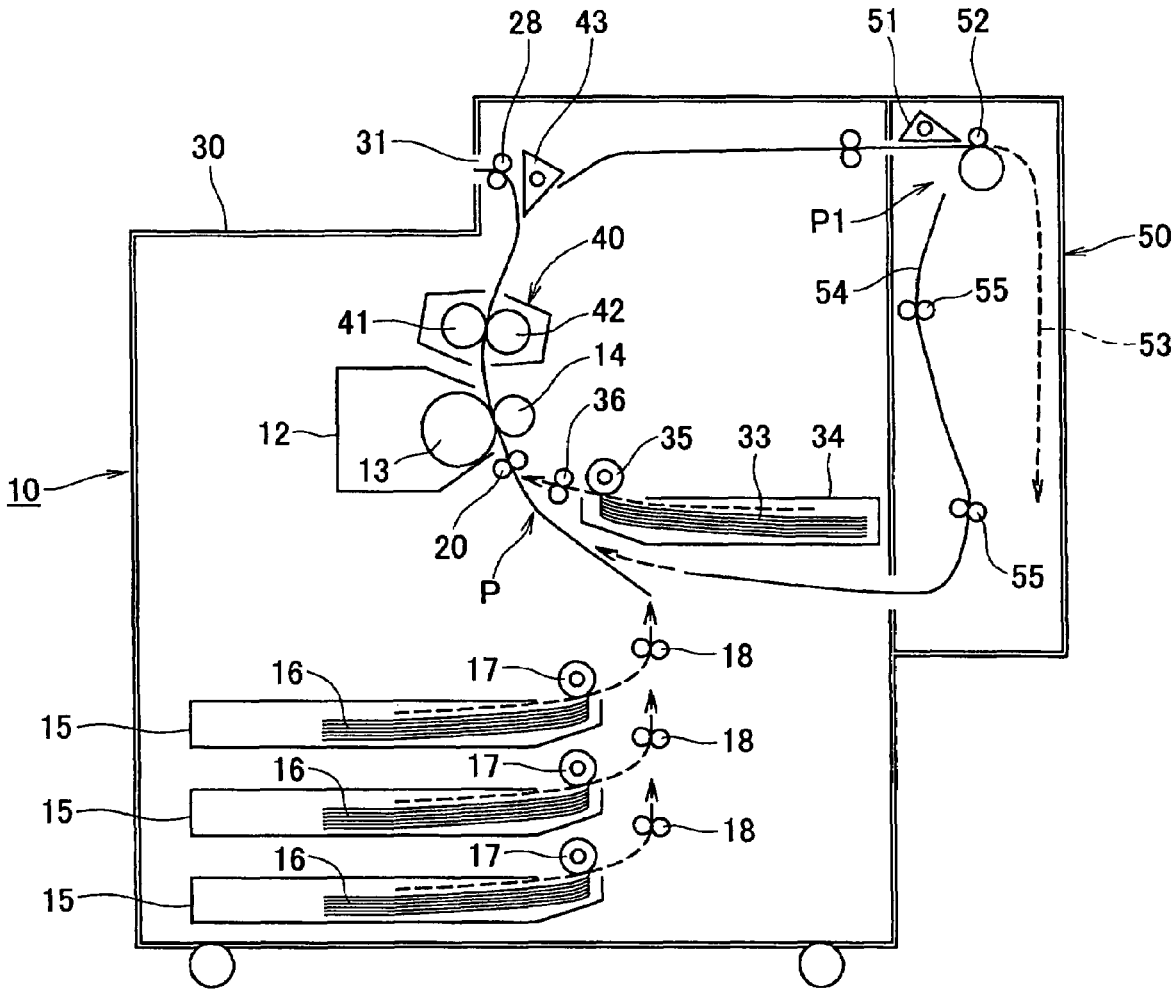
FIG. 3 is another example of a schematic configuration diagram showing an entire portion of an electrophotographic image formation apparatus using a gloss-providing sheet according to the present invention.

FIG. 3 is another example of a schematic configuration diagram showing an entire portion of an electrophotographic image formation apparatus using a gloss-providing sheet according to the present invention.

In the image formation apparatus shown in FIG. 3, operation of the first fixing device 22 and the second fixing device 25 shown in FIG. 1 is also performed using the common and single fixing device 40 and the pressure roller 42 is pressed on the heating roller 41 including a heater therein through biasing using a biasing member not shown in the drawings, thereby forming a fixing nip.

Moreover, the sheet cassette 34 storing the gloss-providing sheet 33 is disposed on an opposite side of the process unit 12 relative to the recording material conveying path P. The gloss-providing sheet 33 fed by the feeding roller 35 is conveyed using the pair of conveying rollers 36 and is guided to the recording material conveying path P before the pair of register rollers 20.

Further, a duplex unit 50 is installed on a right side surface of the image formation apparatus body 10. The duplex unit 50 includes a conveying path P1 for duplex image formation. On the conveying path P1 for duplex image formation, a unit switching claw 51, a pair of reverse rollers 52, a switchback path 53, a refeed path 54, and plural pairs of refeed rollers 55. In the image formation apparatus body 10, a body switching claw 43 is disposed downstream relative to the fixing device 40. By switching a conveying course of the recording material 16 using the body switching claw 43, it is possible to eject the recording material 16 after the fixing to the paper ejection stack portion 30 or to feed the recording material 16 to the duplex unit 50.

When the image formation apparatus in this example forms a low-gloss image on a single surface of the recording material 16, through a signal from the host, operation from the operation display panel not shown in the drawings, or the like, the first image formation mode is set. Then, the process unit 12 is driven and the photoconductor 13 is rotated in the counterclockwise direction so as to form a toner image on the photoconductor 13 by performing charging, writing, and development using the process devices including the charge device, writing device, development device, and the like. On the other hand, one of the paper feed rollers 17 is selectively driven, the recording material 16 is fed from the corresponding recording material storage cassette 15 and is guided to the recording material conveying path P, the recording material 16 is conveyed by the pair of conveying rollers 18, and the tip of the recording material 16 is brought into abutment with the pair of register rollers 20 and the recording material 16 is stopped.

Thereafter, the pair of register rollers 20 is rotated in accordance with the toner image formed on the rotating photoconductor 13 as mentioned above and the recording material 16 is fed to the transfer nip so as to transfer the toner image on the photoconductor 13 to the recording material 16 using the transfer device 14. The recording material having the toner image on the image surface after the transfer of the toner image is guided to the fixing device 40 through the recording material conveying path P and toner is fused by applying heat and pressure using the heating roller 41 and the pressure roller 42 so as to fix the toner image on the recording material 16.

The recording material 16 after the fixing of the toner image is conveyed in the recording material conveying path P and is directed to the paper ejection outlet 31 by switching the conveying course of the recording material 16 using the body switching claw 43. Then, the recording material 16 is ejected from the paper ejection outlet 31 using the pair of paper ejection rollers 28 and is stacked on the paper ejection stack portion 30.

When the image formation apparatus in this example forms low-gloss images on both surfaces of the recording material 16, through a signal from the host, operation from the operation display panel not shown in the drawings, or the like, a third image formation mode is set. The recording material 16 after the formation of the toner image is conveyed to the duplex unit 50 by switching the conveying course of the recording material 16 using the body switching claw 43.

Then, the recording material 16 fed to the conveying path P1 for duplex image formation in the duplex unit 50 is once fed to the switchback path 53 using the switchback path 53. Thereafter, the pair of reverse rollers 52 is reversed and the unit switching claw 51 is driven, so that the recording material 16 after the switchback is guided to the refeed path 54 and is conveyed using the pairs of refeed rollers 55, thereby returning the reversed recording material 16 to the image formation apparatus body 10.

The recording material 16 returned to the image formation apparatus body 10 is fed to the transfer nip again at an appropriate time using the pair of register rollers 20. A toner image newly formed on the photoconductor 13 is transferred to a reverse side of the recording material 16 using the transfer device 14 and the recording material 16 is guided to the fixing device 40 through the recording material conveying path P. Heat and pressure are applied using the heating roller 41 and the pressure roller 42 so as to fuse the toner also in this case and the toner image is fixed on the recording material 16. Then, the conveying course of the recording material 16 is switched using the body switching claw 43. The recording material 16 is ejected from the paper ejection outlet 31 using the pair of paper ejection rollers 28 and is stacked on the paper ejection stack portion 30.

On the other hand, when the image formation apparatus in this example forms a high-gloss image on the recording material 16, through a signal from the host, operation from the operation display panel not shown in the drawings, or the like, the second image formation mode is set. Then, the toner image formed on the photoconductor 13 in the same manner as in the above-mentioned case is transferred to the recording material 16 fed from one of the recording material storage cassettes 15. After the toner is fused once using the fixing device 40 and is fixed, the conveying course of the recording material 16 is switched using the body switching claw 43 and the recording material 16 is conveyed to the duplex unit 50.

Then, the recording material 16 fed to the duplex unit 50 is reversed in the duplex unit 50 in the same manner and is returned to the image formation apparatus body 10. The gloss-providing sheet 33 fed from the sheet cassette 34 is guided to the recording material conveying path P and is placed on the image surface of the recording material 16 returned to the image formation apparatus body 10. Following the pair of register rollers 20, the recording material 16 and the gloss-providing sheet 33 are passed through the transfer nip between the process unit 12 and the transfer device 14 not in operation and are inserted to the fixing device 40 again. Heat and pressure are applied using the heating roller 41 and the pressure roller 42 so as to sufficiently fuse the toner at high temperature again and to adhere the gloss-providing sheet 33 to the recording material 16. Then, the conveying course of the recording material 16 is switched using the body switching claw 43 in the same manner. The recording material 16 is ejected from the paper ejection outlet 31 using the pair of paper ejection rollers 28 and is stacked on the paper ejection stack portion 30.

Thereafter, the gloss-providing sheet 33 is separated after the temperature of the recording material 16 to which the gloss-providing sheet 33 is adhered is lowered such that the toner is solidified.

In the case of this example, when the recording material 16 is passed through the fixing device 40 in the first passing, the image surface of the recording material 16 faces the heating roller 41. However, in the second passing, the recording material 16 is reversed and the image surface faces the pressure roller 42. Accordingly, it is necessary to directly heat the reverse side of the recording material 16 in the second passing through the fixing device by configuring the pressure roller to be capable of functioning as a heating roller, for example.

Also in this example, it is possible to sufficiently fuse the toner at high temperature without generating the problems such as hot offset and winding and to obtain a uniformly smooth high-gloss image in the solid portion, halftone portion, and non-image portion. In particular, this example is greatly effective when a special recording material is used so as to obtain a smooth image surface by disposing a layer coated with thermoplastic resin on a surface thereof and embedding the toner in the coated layer as disclosed in Patent Document 4.

Figure 4:
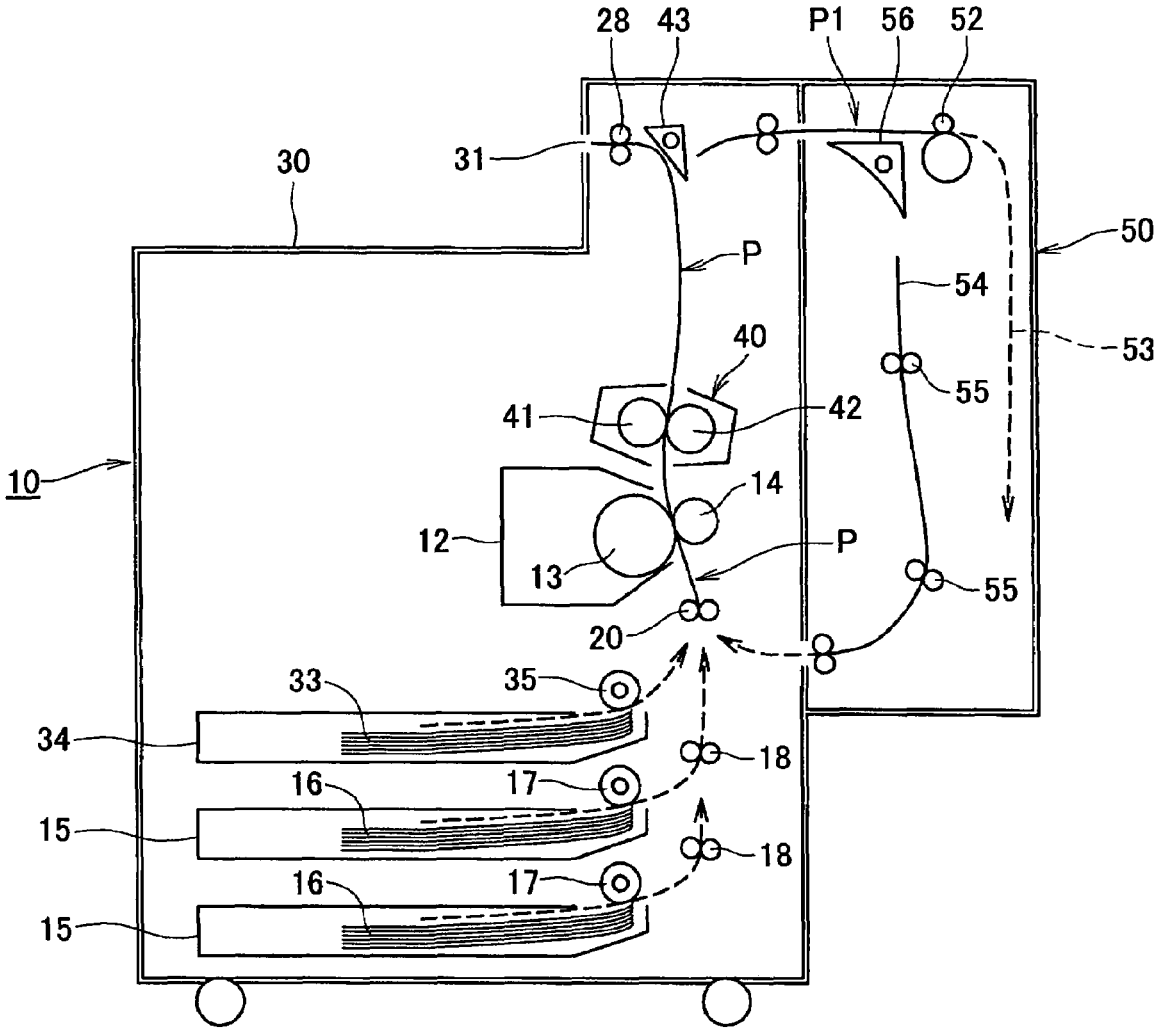
FIG. 4 is another example of a schematic configuration diagram showing an entire portion of an electrophotographic image formation apparatus using a gloss-providing sheet according to the present invention.

FIG. 4 is another example of a schematic configuration diagram showing an entire portion of an electrophotographic image formation apparatus using a gloss-providing sheet according to the present invention. This example has substantially the same structure as in the example shown in FIG. 3 and the same reference numerals as in FIG. 3 are assigned to corresponding elements.

In this example, a top stage of the recording material storage cassettes 15 shown in FIG. 3 is disposed as the sheet cassette 34 storing the gloss-providing sheet 33. In other words, the sheet cassette 34 disposed on the opposite side of the process unit 12 relative to the recording material conveying path P in the example of FIG. 3 is disposed on the same side of the process unit 12. And, the gloss-providing sheet 33 fed by the feeding roller 35 is guided to the recording material conveying path P before the pair of register rollers 20 in the same manner.

Further, although the example shown in FIG. 3 includes the unit switching claw 51 for switching between a first position for guiding the recording material 16 fed to the duplex unit 50 to the switchback path 53 and a second position for guiding the recording material 16 after the switchback from the switchback path 53 to the refeed path 54, another unit switching claw 56 is disposed in this example instead of the unit switching claw 51.

Figure 5A:
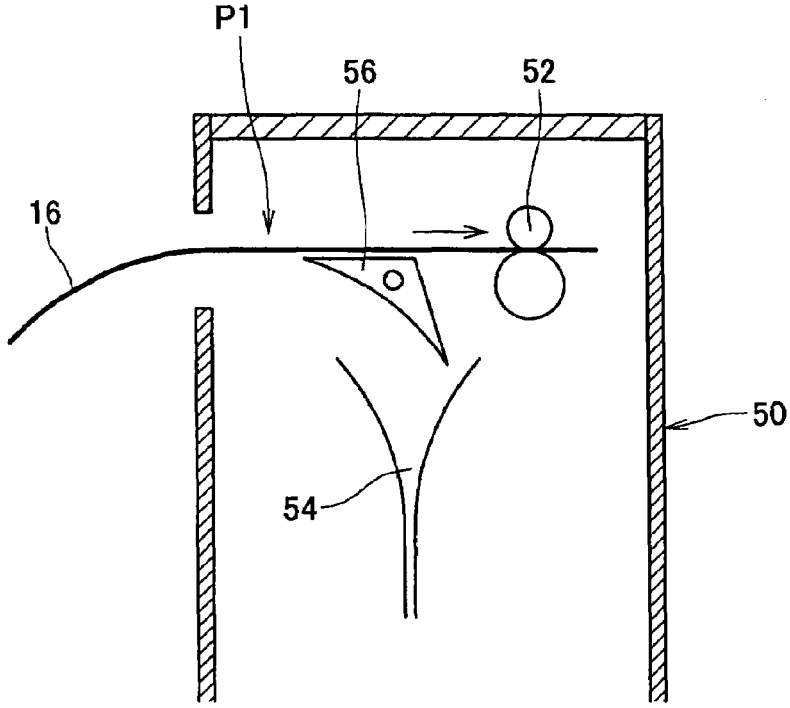
FIG. 5A is an illustration showing a first position of a unit switching claw in a duplex image formation mode.
Figure 5B:
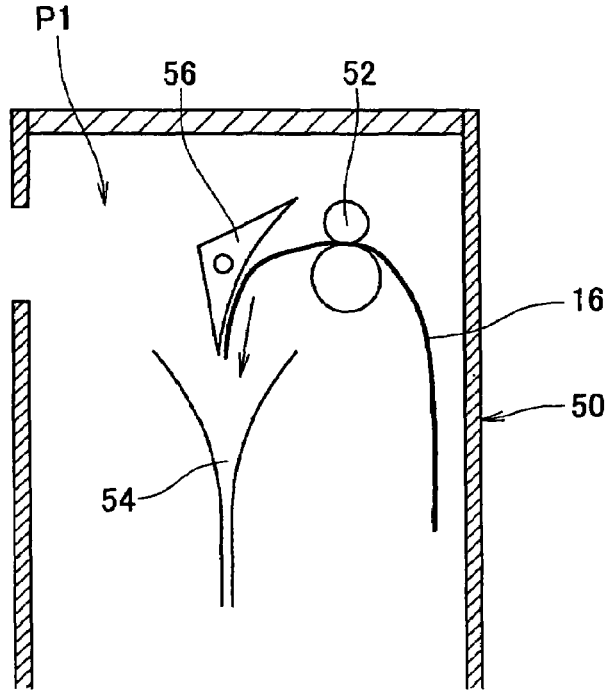
FIG. 5B is an illustration showing a second position of a unit switching claw in a duplex image formation mode.
Figure 6:
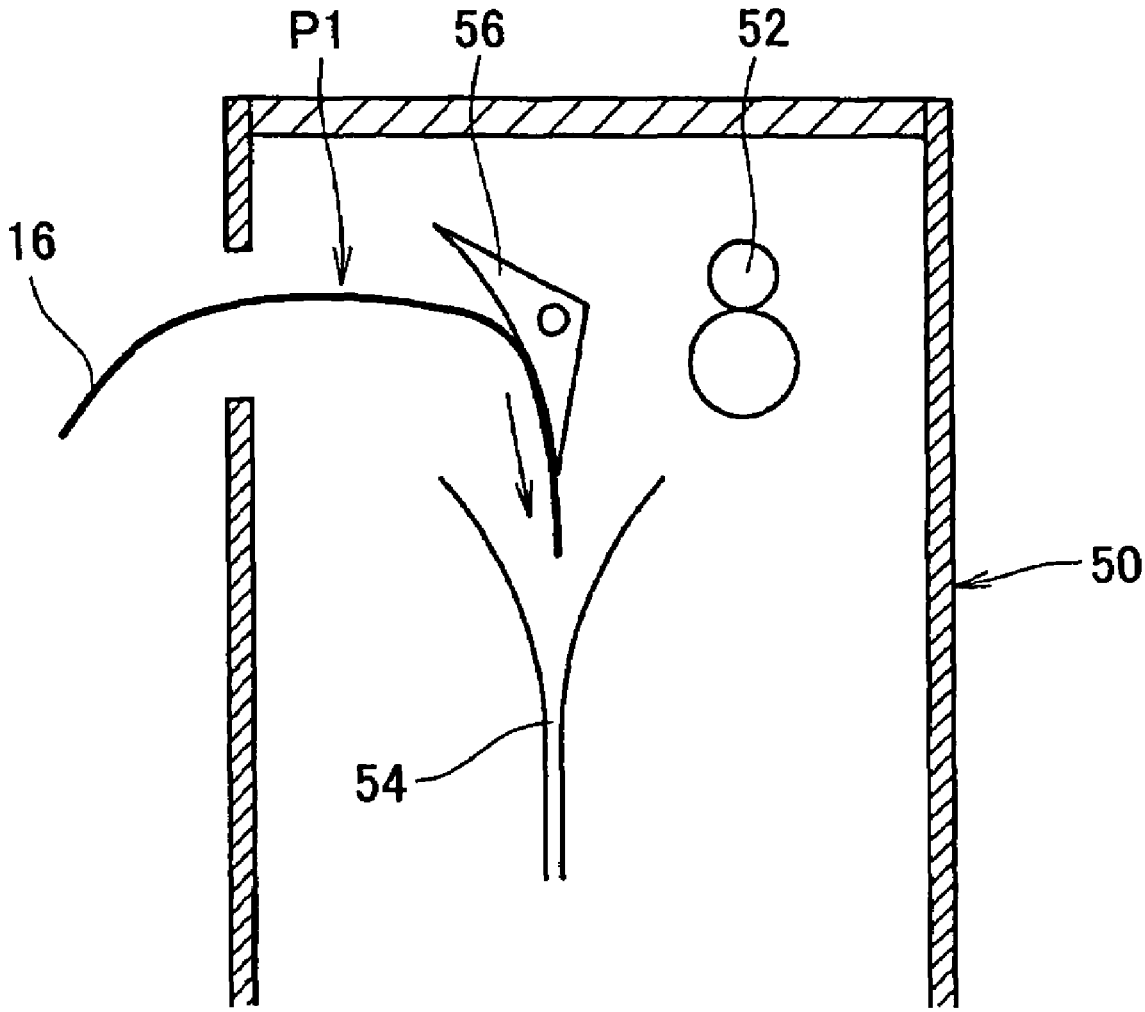
FIG. 6 is an illustration showing a third position of a unit switching claw in a high-gloss image formation mode.

The unit switching claw 56 is configured to switch, in the third image formation mode, among the first position for guiding the recording material 16 fed to the conveying path P1 for duplex image formation in the duplex unit 50 to the switchback path 53 as shown in FIG. 5A, the second position for guiding the recording material 16 after the switchback from the switchback path 53 to the refeed path 54 as shown in FIG. 5B in the same manner as in the unit switching claw 51 shown in FIG. 3, and a third position for directly guiding the recording material 16 fed to the duplex unit 50 to the refeed path 54 as shown in FIG. 6.

When the image formation apparatus forms a low-gloss image on a single surface or both surfaces of the recording material 16, the first image formation mode or the third image formation mode is set in the same manner as shown in the example of FIG. 3. However, when the image formation apparatus forms a high-gloss image, through a signal from the host, operation from the operation display panel not shown in the drawings, or the like, the second image formation mode is set and the unit switching claw 56 assumes the third position shown in FIG. 6.

Then, the toner image formed on the photoconductor 13 is transferred to the recording material 16 fed from one of the recording material storage cassettes 15 and the toner is fused once using the fixing device 40 and is fixed. Thereafter, the conveying course of the recording material 16 is switched using the body switching claw 43 and the recording material 16 is conveyed to the duplex unit 50 in the same manner. However, in this example, the recording material 16 fed to the duplex unit 50 is directly guided to the refeed path 54 without switchback operation using the unit switching claw 56, conveyed using the pairs of refeed rollers 55, and returned to the image formation apparatus body 10 without being reversed.

The gloss-providing sheet 33 fed from the sheet cassette 34 is guided to the recording material conveying path P and is placed on the image surface of the recording material 16 returned to the image formation apparatus body 10. Following the pair of register rollers 20, the recording material 16 and the gloss-providing sheet 33 are passed through the transfer nip between the process unit 12 and the transfer device 14 not in operation and are inserted to the fixing device 40 again. Heat and pressure are applied using the heating roller 41 and the pressure roller 42 so as to sufficiently fuse the toner at high temperature again and to adhere the gloss-providing sheet 33 to the recording material 16. Then, the conveying course of the recording material 16 is switched using the body switching claw 43 in the same manner. The recording material 16 is ejected from the paper ejection outlet 31 using the pair of paper ejection rollers 28 and is stacked on the paper ejection stack portion 30.

Thereafter, the gloss-providing sheet 33 is separated after the temperature of the recording material 16 to which the gloss-providing sheet 33 is adhered is lowered such that the toner is solidified.

Also in this example, it is possible to sufficiently fuse the toner at high temperature without generating the problems such as hot offset and winding and to obtain a uniformly smooth high-gloss image in the solid portion, halftone portion, and non-image portion. In particular, this example is greatly effective when a special recording material is used so as to obtain a smooth image surface by disposing a layer coated with thermoplastic resin on a surface thereof and embedding the toner in the coated layer as disclosed in Patent Document 4.

In addition, according to this example, the unit switching claw 56 for switching the conveying course of the recording material 16 depending on a duplex image formation mode and a high-gloss image formation mode is disposed on the recording material conveying path P included in the duplex unit 50. Thus, by setting the high-gloss image formation mode in which the recording material 16 is passed through the fixing device 40 in the first passing and refeeding of paper is enabled without reversing the recording material 16 after fixing of the toner, it is possible arrange a feeding direction of the gloss-providing sheet 33 and a feeding direction of the recording material 16 in the same direction and to dispose the sheet cassette 34 above the recording material storage cassette 15. In accordance with this, it is possible to densely arrange elements and downsize the image formation apparatus without complicating the structure.

In the example shown in FIG. 3, the image surface of the recording material 16 passed through the fixing device 40 in the first passing is reversed in the second passing, so that the pressure roller must also function as a heating roller, for example. However, according to this example, the image surface is positioned on the same side in the first passing and the second passing, so that only the heating roller 41 is required to function as a heating roller. The structure is simplified also in this arrangement.

It is necessary to separate the gloss-providing sheet 33 after the temperature of the recording material 16 stacked on the paper ejection stack portion 30 is lowered such that the toner is solidified. However, the problem here is that the user may separate the gloss-providing sheet 33 when the temperature of the recording material 16 is high such that the toner is not solidified. In this case, it is not possible to obtain smoothness of the toner surface provided in accordance with the smooth surface of the gloss-providing sheet 33, so that a uniform high-gloss image is not obtained. In view of this, the user may be notified of an appropriate time when it is possible to separate the gloss-providing sheet 33 from the recording material 16.

The gloss-providing sheet 33 according to the present invention solves the above-mentioned problem. A notification portion for developing color when the temperature becomes equal to or lower than the glass transition temperature of toner is disposed on the gloss-providing sheet 33 for providing high gloss to a toner image on the recording material 16 in which the gloss-providing sheet 33 is placed on the toner image surface of the recording material 16, the toner is fused through heating, and then the gloss-providing sheet 33 is separated from the recording material 16 after the toner is cooled and solidified as mentioned above. In other words, in the present invention, based on a phenomenon of color development of a color material at low temperature, the notification portion using such a color material is formed on the surface or in an internal portion of the gloss-providing sheet 33. Specifically, such a color material is printed on the sheet, a sticker using such a color material is adhered to the sheet, such a color material is embedded in the internal portion of the sheet, or sheet is laminated and such a color material is held inside for example. However, the method for forming the notification portion is not limited to these examples.

As mentioned above, in order to obtain a uniform high-gloss image, it is necessary to sufficiently fuse the toner, so that the temperature of the toner immediately after passing through the fixing device is very high and the toner is becoming solidified while it is gradually cooled. When a temperature of the notification portion for developing color is set such that the toner is sufficiently solidified, it is possible to clearly notify the user that the gloss-providing sheet 33 may be separated from the recording material 16. Thus, the temperature for developing color is required to be equal to or lower than the glass transition temperature of toner (softening temperature) and preferably lower than the glass transition temperature of toner (softening temperature) by 20° C. or more. Specifically, the current glass transition temperature of toner is about 70° C., so that the temperature for developing color is preferably not more than 50° C.

The notification portion may be configured to develop color simply in an entire sheet or a portion of the sheet. However, in order to prevent erroneous separation by the user, it is necessary to write instructions in a manual or the like such that the sheet must be separated after the phenomenon of color development has occurred.

Figure 7A:
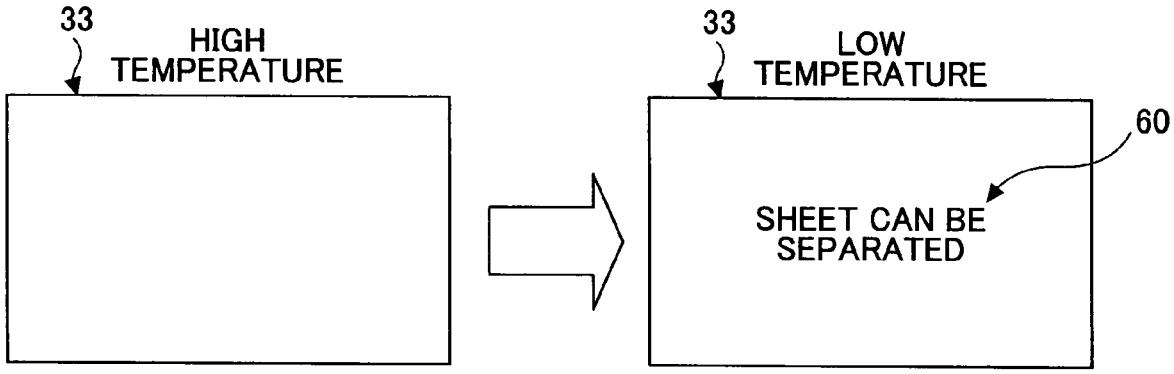
FIG. 7A is a plan view showing an example of a gloss-providing sheet according to the present invention.
Figure 7B:
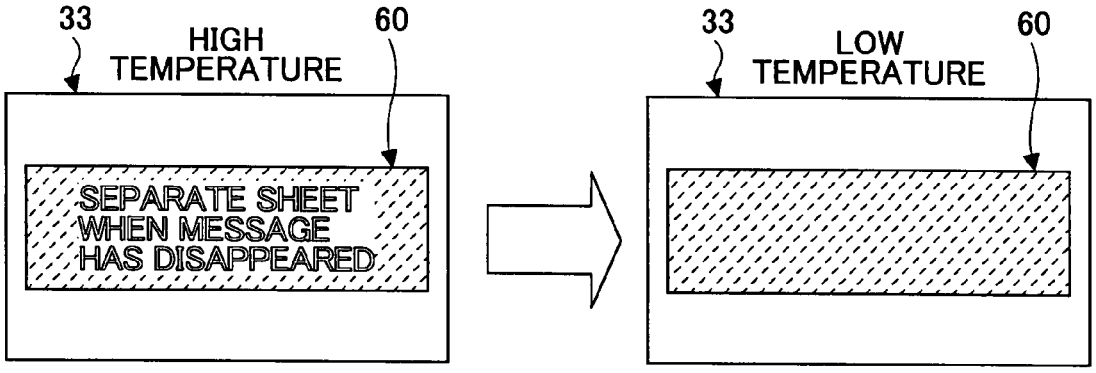
FIG. 7B is a plan view showing another example of a gloss-providing sheet according to the present invention.

In the above-mentioned method, the meaning of the color development is not clear, so that it is desirable to display a character string on a notification portion 60 as shown in FIGS. 7A and 7B. In this manner, it is possible to clearly know the fact that the sheet may be separated.

In an example shown in FIG. 7A, for example, when the recording material 16 is output on the paper ejection stack portion 30, the temperature of the notification portion 60 of the gloss-providing sheet 33 is high, so that color is not developed. However, when the temperature is lowered thereafter such that the toner is solidified, color is developed and a character string "sheet can be separated" is displayed on the notification portion 60. Further, in an example shown in FIG. 7B, a background of the notification portion 60 is always colored and when the recording material 16 is output on the paper ejection stack portion 30, color is not developed because of high temperature. Although a character string "separate sheet when message has disappeared" is displayed as a ground color on the notification portion 60 such that the message is embossed on the background, when the temperature is lowered such that the toner is solidified, the same color as in the background of the notification portion 60 is developed and the message that has been displayed is disappeared.

In the method as shown in FIG. 7A, immediately after the recording material 16 is output on the paper ejection stack portion 30, no message is displayed on the sheet, so that the user may erroneously separate the sheet. However, in the method as shown in FIG. 7B, when the recording material 16 is output on the paper ejection stack portion 30, the message is readable because of the background of the notification portion 60. Thus, it is possible to prevent erroneous separation by the user and allow the user to appropriately notice a time for separating the gloss-providing sheet 33 from the recording material 16.

There are two types of color materials for developing color at low temperature used in this example.

A first color material does not develop color before the heating and through the heating (namely, no change is observed while the temperature is on the rise). Then, the color material develops color when the temperature becomes low.

A second color material develops color before the heating. The color material eliminates color through the heating (namely, color is eliminated while the temperature is on the rise). Then, the color material develops color again when the temperature becomes low. In other words, the color material reversibly develops color and eliminates color repeatedly in accordance with the temperature. Such a phenomenon of reversibly changing color in accordance with the temperature is referred to as thermochromism. Typical examples of thermochromism include a well-known method using liquid crystal and leuco dye and this method can be applied to the present invention. However, the method is not limited to this. Any method provides merits of allowing reuse of the gloss-providing sheet as long as the color development and the color elimination are reversibly repeated.

A most suitable color material to be used in this example is microencapsulated pigment with reversible thermochromic properties. This is a well-known technique in which the leuco dye, developer, and desensitizer are contained in microcapsules. For example, such color materials are commercialized by Matsui Shikiso Chemical Co., Ltd, Japan Capsular Products Inc., Chemitech Inc., Dainippon Ink and Chemicals Inc., and the like. In general, this microencapsulated pigment with reversible thermochromic properties does not develop color at high temperature and develops color at low temperature. It is possible to set a temperature for color change within a range from 0° C. to 65° C., so that it is possible to set a temperature appropriate for the present invention.

Although the examples shown in FIGS. 7A and 7B include the notification portion 60 for developing color when the temperature becomes equal to or lower than the glass transition temperature of toner, the notification portion 60 may be configured to eliminate color when the temperature becomes equal to or lower than the glass transition temperature of toner. In other words, when the recording material 16 is output on the paper ejection stack portion 30, the temperature is high, so that the character string "separate sheet when message has disappeared" is displayed on the notification portion 60 of the gloss-providing sheet 33. However, when the temperature is lowered such that the toner is solidified thereafter, color is eliminated and the message which has been displayed becomes unreadable, so that it is possible to allow the user to recognize the fact that the gloss-providing sheet 33 may be separated from the recording material 16.

As other methods for forming the notification portion 60, such a color material is printed on the sheet, a sticker using such a color material is adhered to the sheet, such a color material is embedded in the internal portion of the sheet, or sheet is laminated and such a color material is held inside for example. However, the method for forming the notification portion 60 is not limited to these examples.

In the same manner, the temperature for eliminating color is required to be equal to or lower than the glass transition temperature of toner (softening temperature) and preferably lower than the glass transition temperature of toner (softening temperature) by 20° C. or more. As mentioned above, the current glass transition temperature of toner is about 70° C., so that the temperature for eliminating color is preferably not more than 50° C.

Figure 8A:
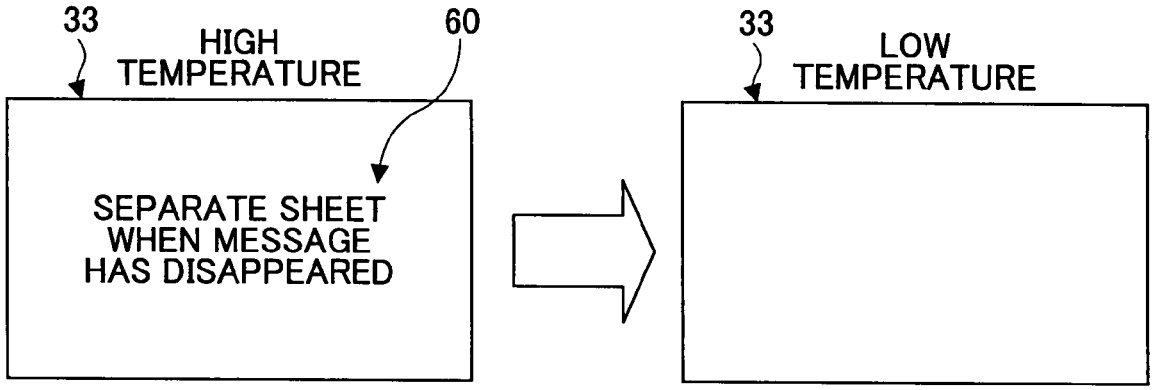
FIG. 8A is a plan view showing another example of a gloss-providing sheet according to the present invention.

Also in this case, the notification portion 60 may be disposed simply on the entire sheet or a portion of the sheet. And the notification portion 60 may be configured to eliminate color from the entire sheet or a portion of the sheet. However, in order to prevent erroneous separation by the user, it is necessary to write instructions in the manual or the like such that the sheet must be separated after the phenomenon of color elimination has occurred. The meaning of the color elimination is not clear, so that it is desirable to display a character string on a portion of color elimination as shown in FIG. 8A.

There are two types of color materials for eliminating color at low temperature used in this example.

A first color material develops color before the heating and through the heating (namely, no change is observed while the temperature is on the rise). Then, the color material eliminates color when the temperature becomes low.

A second color material does not develop color before the heating. The color material develops color through the heating (namely, color is developed while the temperature is on the rise). Then, the color material eliminates color when the temperature becomes low. In other words, the color material reversibly develops color and eliminates color repeatedly in accordance with the temperature. Such a phenomenon of reversibly changing color in accordance with the temperature is referred to as thermochromism. Typical examples of thermochromism include a well-known method using liquid crystal and leuco dye and this method can be applied to the present invention. However, the method is not limited to this. Any method provides merits of allowing reuse of the gloss-providing sheet as long as the color development and the color elimination are reversibly repeated.

The color material developing color at high temperature and eliminating color at low temperature (normal temperature) as used in this example is less common. However, Japanese Laid-Open Patent Application No. 2002-322385 has been proposed, for example. Further, in order to use such a color material, it is appropriate to use a color material in which the leuco dye, developer, and desensitizer are contained in microcapsules (microencapsulated pigment with reversible thermochromic properties).

Moreover, the examples shown in FIGS. 7A and 7B include the notification portion 60 for developing color when the temperature becomes equal to or lower than the glass transition temperature of toner and the example shown in FIG. 8A includes the notification portion 60 for eliminating color when the temperature becomes equal to or lower than the glass transition temperature of toner. However, the notification portion 60 may be configured to change color when the temperature becomes equal to or lower than the glass transition temperature of toner.

Figure 8B:
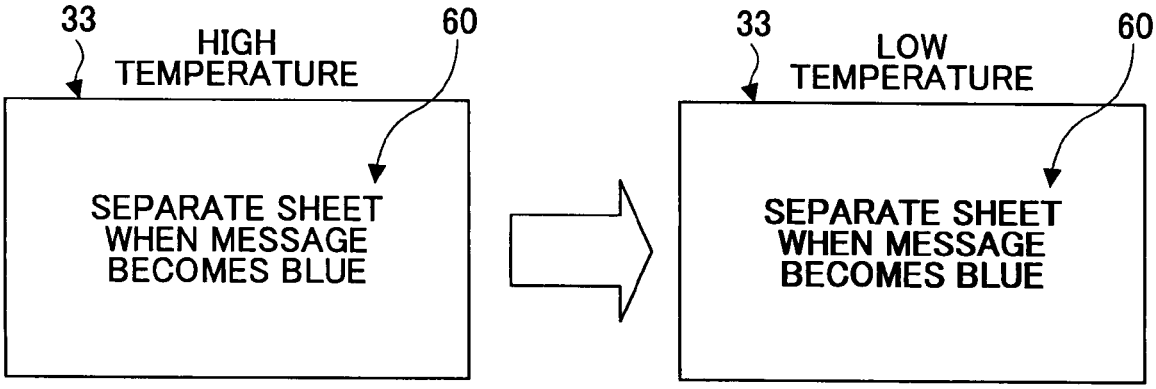
FIG. 8B is a plan view showing another example of a gloss-providing sheet according to the present invention.

Specifically, as shown in FIG. 8B, when the recording material 16 is output on the paper ejection stack portion 30, the temperature is high, so that a pink character string "separate sheet when message becomes blue" is displayed on the notification portion 60 of the gloss-providing sheet 33. When the temperature becomes low thereafter such that the toner is solidified, the message changes color thereof and the message which has been displayed using the pink character string becomes blue so as to allow the user to readily recognize the fact that the gloss-providing sheet 33 may be separated.

As other methods for forming the notification portion 60, such a color material is printed on the sheet, a sticker using such a color material is adhered to the sheet, such a color material is embedded in the internal portion of the sheet, or sheet is laminated and such a color material is held inside for example. However, the method for forming the notification portion 60 is not limited to these examples.

In the same manner, the temperature for changing color is required to be equal to or lower than the glass transition temperature of toner (softening temperature) and preferably lower than the glass transition temperature of toner (softening temperature) by 20° C. or more. As mentioned above, the current glass transition temperature of toner is about 70° C., so that the temperature for changing color is preferably not more than 50° C.

Also in this case, the notification portion 60 may be disposed simply on the entire sheet or a portion of the sheet. And the notification portion 60 may be configured to change color in the entire sheet or a portion of the sheet. However, in order to prevent erroneous separation by the user, it is necessary to write instructions in the manual or the like such that the sheet must be separated after the phenomenon of color change has occurred. The meaning of the color change is not clear, so that it is desirable to display a character string on a portion of color change as shown in FIG. 8B.

In the method using the color development and the color elimination as mentioned above, judgment of status is assumed to be difficult when the color of the message is light. However, the method using the color change as in this example has merits in that judgment is clearly made by observing a difference of color. Further, the message is always colored and no blank status is generated, so that the method has other merits in that it is possible to prevent misunderstanding by the user.

There are two types of color materials for changing color at low temperature used in this example.

In a first color material, a color before the heating is not changed through the heating (rise of temperature) but is changed when the temperature becomes low.

In a second color material, the color before the heating is changed through the heating (rise of temperature) and is returned to the original color when the temperature becomes low. In other words, the color material reversibly changes color repeatedly in accordance with the temperature. Such a phenomenon of reversibly changing color in accordance with the temperature is referred to as thermochromism. Typical examples of thermochromism include a well-known method using liquid crystal and leuco dye and this method can be applied to the present invention. However, the method is not limited to this. Any method provides merits of allowing reuse of the gloss-providing sheet as long as the color change is reversibly repeated.

A most suitable color material to be used in this example is also microencapsulated pigment with reversible thermochromic properties. In general, this microencapsulated pigment with reversible thermochromic properties does not develop color at high temperature and develops color at low temperature. In addition to this, when normal pigment is used, it is possible to have color change using different colors at high temperature and low temperature. By using this, it is possible to select various color combinations. In FIG. 8B, a combination of pink at high temperature and blue at low temperature is used. It is possible to set a temperature for color change within a range from 0C to 65° C., so that it is possible to set a temperature appropriate for the present invention.

In the following, other embodiments of the present invention will be described with reference to the accompanying drawings.

FIG. 1 is a schematic configuration diagram showing an entire portion of an electrophotographic image formation apparatus according to the present invention.

An image formation apparatus body referenced at 10 includes a process unit 12 detachably disposed on a middle portion. A photoconductor 13 having a drum-like shape is rotatably disposed on the process unit 12 and a charging unit, development unit, and the like (not shown in the drawings) are disposed on a periphery of the photoconductor 13. Further, in the vicinity of the process unit 12 (not shown in the drawings), a writing unit is disposed. A transfer device 14 having a roller shape is pressed on the photoconductor 13 of the process unit 12, the transfer device 14 being disposed so as to face the photoconductor 13 across a recording material conveying path P, thereby forming a transfer nip.

In the image formation apparatus body 10, recording material storage cassettes 15 are each detachably disposed in three stages below the process unit 12. Recording materials 16 having different size are loaded and stored in each recording material storage cassette 15. In general, paper is used as the recording material 16. Each recording material storage cassette 15 includes a paper feed roller 17 for feeding the stored recording material 16 and a pair of conveying rollers 18 for guiding the supplied recording material 16 to the recording material conveying path P and conveying the recording material 16 upward.

On the recording material conveying path P extending from a lower portion to an upper portion on a right side in the image formation apparatus body 10, a pair of register rollers 20 is disposed before the transfer nip and a first fixing device 22 is disposed after passing through the transfer nip. The first fixing device 22 presses a first pressure roller 24 on a first heating roller 23 including a heater therein through biasing using a biasing member not shown in the drawings, thereby forming a first fixing nip.

Along with a shape of the recording material conveying path P, a second fixing device 25 is disposed downstream relative to the first fixing device 22. In the same manner as in the first fixing device 22, the second fixing device 25 presses a second pressure roller 27 on a second heating roller 26 including a heater therein through biasing using a biasing member not shown in the drawings, thereby forming a second fixing nip. Further, a pair of paper ejection rollers 28 is disposed downstream relative to the second fixing device 25 and a paper ejection outlet 31 is subsequently disposed for a paper ejection stack portion 30 on the image formation apparatus body 10.

In the recording material conveying path P between the first fixing device 22 and the second fixing device 25, a gloss-providing sheet 33 is allowed to join a flow such that the gloss-providing sheet 33 is placed on an image surface of the recording material 16. The gloss-providing sheet 33 has a smooth surface and is loaded and stored in a sheet cassette 34 detachably disposed above the process unit 12. The gloss-providing sheet 33 is fed by a feeding roller 35, conveyed by a pair of conveying rollers 36, and guided to the recording material conveying path P in accordance with a time when the recording material 16 is conveyed in the recording material conveying path P.

When the image formation apparatus in this example forms a low-gloss image on the recording material 16, through a signal from a host, operation from an operation display panel not shown in the drawings, or the like, a first image formation mode is set in which the recording material 16 is ejected only through the first fixing device 22. Then, the process unit 12 is driven and the photoconductor 13 is rotated in the counterclockwise direction so as to form a toner image on the photoconductor 13 by performing charging, writing, and development using process devices including a charge device, writing device, development device, and the like. On the other hand, one of the paper feed rollers 17 is selectively driven, the recording material 16 is fed from the corresponding recording material storage cassette 15 and is guided to the recording material conveying path P, the recording material 16 is conveyed by the pair of conveying rollers 18, and a tip of the recording material 16 is brought into abutment with the pair of register rollers 20 and the recording material 16 is stopped.

Thereafter, the pair of register rollers 20 is rotated in accordance with the toner image formed on the rotating photoconductor 13 as mentioned above and the recording material 16 is fed to the transfer nip so as to transfer the toner image on the photoconductor 13 to the recording material 16 using the transfer device 14. The recording material having the toner image on the image surface after the transfer of the toner image is guided to the first fixing device 22 through the recording material conveying path P and toner is fused by applying heat and pressure using the first heating roller 23 and the first pressure roller 24 so as to fix the toner image on the recording material 16.

The recording material 16 after the fixing of the toner image is directly conveyed in the recording material conveying path P and is passed through the second fixing device 25 not in operation, namely, generating no heat. Then, the recording material 16 is ejected from the paper ejection outlet 31 using the pair of paper ejection rollers 28 and is stacked on the paper ejection stack portion 30.

On the other hand, when the image formation apparatus in this example forms a high-gloss image on the recording material 16, through a signal from the host, operation from the operation display panel not shown in the drawings, or the like, a second image formation mode is set in which the recording material 16 is ejected through both first fixing device 22 and second fixing device 25. The toner image formed on the photoconductor 13, in the same manner as in the case of forming the low-gloss image, is transferred to the recording material 16 fed from one of the recording material storage cassettes 15. After the toner is fused once and fixed using the first fixing device 22, the gloss-providing sheet 33 fed from the sheet cassette 34 is placed on the image surface of the image-fixed recording material 16 and the recording material 16 is guided to the second fixing device 25. The toner is sufficiently fused again at high temperature by applying heat and pressure using the second heating roller 26 and the second pressure roller 27 so as to adhere the gloss-providing sheet 33 to the recording material 16. Then, the recording material 16 is ejected from the paper ejection outlet 31 using the pair of paper ejection rollers 28 and is stacked on the paper ejection stack portion 30 in the same manner as in the case of forming the low-gloss image.

Thereafter, the gloss-providing sheet 33 is separated after a temperature of the recording material 16 to which the gloss-providing sheet 33 is adhered is lowered such that the toner is solidified. It is possible to have a process for automatically separating the gloss-providing sheet 33 from the recording material 16 before the recording material 16 is ejected from the paper ejection outlet 31 using the pair of paper ejection rollers 28. In this manner, it is possible to allow the user to eliminate a manual operation for separating the gloss-providing sheet 33 from the recording material 16. However, in this case, it is necessary to have a process for waiting until the temperature is lowered before separating the gloss-providing sheet 33.

As mentioned above, in the image formation apparatus of this example, the toner is fused once and the toner image is fixed on the recording material 16, and then the toner is fused again and the gloss-providing sheet 33 is adhered to the recording material 16. Thus, it is possible to sufficiently fuse the toner at high temperature without generating the problems such as hot offset and winding. In a surface of the fused toner, a smooth surface of the gloss-providing sheet 33 is transferred and the toner is solidified in accordance with the smooth sheet surface, so that it is possible to obtain a high-gloss image which uniformly smooth in a solid portion, halftone portion, and non-image portion. This is more effective when a special recording material is used so as to obtain a smooth image surface by disposing a layer coated with thermoplastic resin on a surface thereof and embedding the toner in the coated layer as disclosed in Patent Document 4 in particular.

Further, it is possible to use a structure of a general fixing device conventionally employed, so that a practical apparatus is provided without requiring a high-cost and large-scale device or major change of design. In particular, when the recording material 16 is ejected while the gloss-providing sheet 33 is adhered to the recording material 16, there is a great advantage in that it is possible to perform output at high speed without having cooling time for solidifying the toner.

In this case, when the gloss-providing sheet 33 is coated with mold release agent on a surface to be placed on the image surface of the recording material 16, it is possible to reduce adhesion of the toner to the gloss-providing sheet 33 using the mold release agent. Thus, the toner is not adhered to the gloss-providing sheet 33 when the gloss-providing sheet 33 is separated from the recording material 16 and it is possible to prevent reduction of image quality.

When the gloss-providing sheet 33 after being separated from the recording material 16 is storable after use in the sheet cassette 34 detached from the image formation apparatus body 10, it is possible to reduce cost without wasting the gloss-providing sheet 33 and meet the social demand of effective use of resources in recent years.

FIG. 3 is another schematic configuration diagram showing an entire portion of an electrophotographic image formation apparatus according to the present invention.

In the image formation apparatus shown in FIG. 3, operation of the first fixing device 22 and the second fixing device 25 shown in FIG. 1 is performed using a common and single fixing device 40 and the pressure roller 42 is pressed on the heating roller 41 including a heater therein through biasing using a biasing member not shown in the drawings, thereby forming a fixing nip.

Moreover, the sheet cassette 34 storing the gloss-providing sheet 33 is disposed on an opposite side of the process unit 12 relative to the recording material conveying path P. The gloss-providing sheet 33 fed by the feeding roller 35 is conveyed using the pair of conveying rollers 36 and is guided to the recording material conveying path P before the pair of register rollers 20.

Further, a duplex unit 50 is installed on a right side surface of the image formation apparatus body 10. The duplex unit 50 includes a conveying path P1 for duplex image formation. On the conveying path P1 for duplex image formation, a unit switching claw 51, a pair of reverse rollers 52, a switchback path 53, a refeed path 54, and plural pairs of refeed rollers 55. In the image formation apparatus body 10, a body switching claw 43 is disposed downstream relative to the fixing device 40. By switching a conveying course of the recording material 16 using the body switching claw 43, it is possible to eject the recording material 16 after the fixing to the paper ejection stack portion 30 or to feed the recording material 16 to the duplex unit 50.

When the image formation apparatus in this example forms a low-gloss image on a single surface of the recording material 16, through a signal from the host, operation from the operation display panel not shown in the drawings, or the like, the first image formation mode is set. Then, the process unit 12 is driven and the photoconductor 13 is rotated in the counterclockwise direction so as to form a toner image on the photoconductor 13 by performing charging, writing, and development using the process devices including the charge device, writing device, development device, and the like. On the other hand, one of the paper feed rollers 17 is selectively driven, the recording material 16 is fed from the corresponding recording material storage cassette 15 and is guided to the recording material conveying path P, the recording material 16 is conveyed by the pair of conveying rollers 18, and the tip of the recording material 16 is brought into abutment with the pair of register rollers 20 and the recording material 16 is stopped.

Thereafter, the pair of register rollers 20 is rotated in accordance with the toner image formed on the rotating photoconductor 13 as mentioned above and the recording material 16 is fed to the transfer nip so as to transfer the toner image on the photoconductor 13 to the recording material 16 using the transfer device 14. The recording material having the toner image on the image surface after the transfer of the toner image is guided to the fixing device 40 through the recording material conveying path P and toner is fused by applying heat and pressure using the heating roller 41 and the pressure roller 42 so as to fix the toner image on the recording material 16.

The recording material 16 after the fixing of the toner image is conveyed in the recording material conveying path P and is directed to the paper ejection outlet 31 by switching the conveying course of the recording material 16 using the body switching claw 43. Then, the recording material 16 is ejected from the paper ejection outlet 31 using the pair of paper ejection rollers 28 and is stacked on the paper ejection stack portion 30.

When the image formation apparatus in this example forms low-gloss images on both surfaces of the recording material 16, through a signal from the host, operation from the operation display panel not shown in the drawings, or the like, a third image formation mode is set. The recording material 16 after the formation of the toner image is conveyed to the duplex unit 50 by switching the conveying course of the recording material 16 using the body switching claw 43.

Then, the recording material 16 fed to the conveying path P1 for duplex image formation in the duplex unit 50 is once fed to the switchback path 53 using the switchback path 53. Thereafter, the pair of reverse rollers 52 is reversed and the unit switching claw 51 is driven, so that the recording material 16 after the switchback is guided to the refeed path 54 and is conveyed using the pairs of refeed rollers 55, thereby returning the reversed recording material 16 to the image formation apparatus body 10.

The recording material 16 returned to the image formation apparatus body 10 is fed to the transfer nip again at an appropriate time using the pair of register rollers 20. A toner image newly formed on the photoconductor 13 is transferred to a reverse side of the recording material 16 using the transfer device 14 and the recording material 16 is guided to the fixing device 40 through the recording material conveying path P. Heat and pressure are applied using the heating roller 41 and the pressure roller 42 so as to fuse the toner also in this case and the toner image is fixed on the recording material 16. Then, the conveying course of the recording material 16 is switched using the body switching claw 43. The recording material 16 is ejected from the paper ejection outlet 31 using the pair of paper ejection rollers 28 and is stacked on the paper ejection stack portion 30.

On the other hand, when the image formation apparatus in this example forms a high-gloss image on the recording material 16, through a signal from the host, operation from the operation display panel not shown in the drawings, or the like, the second image formation mode is set. Then, the toner image formed on the photoconductor 13 in the same manner as in the above-mentioned case is transferred to the recording material 16 fed from one of the recording material storage cassettes 15. After the toner is fused once using the fixing device 40 and is fixed, the conveying course of the recording material 16 is switched using the body switching claw 43 and the recording material 16 is conveyed to the duplex unit 50.

Then, the recording material 16 fed to the duplex unit 50 is reversed in the duplex unit 50 in the same manner and is returned to the image formation apparatus body 10. The gloss-providing sheet 33 fed from the sheet cassette 34 is guided to the recording material conveying path P and is placed on the image surface of the recording material 16 returned to the image formation apparatus body 10. Following the pair of register rollers 20, the recording material 16 and the gloss-providing sheet 33 are passed through the transfer nip between the process unit 12 and the transfer device 14 not in operation and are inserted to the fixing device 40 again. Heat and pressure are applied using the heating roller 41 and the pressure roller 42 so as to sufficiently fuse the toner at high temperature again and to adhere the gloss-providing sheet 33 to the recording material 16. Then, the conveying course of the recording material 16 is switched using the body switching claw 43 in the same manner. The recording material 16 is ejected from the paper ejection outlet 31 using the pair of paper ejection rollers 28 and is stacked on the paper ejection stack portion 30.

Thereafter, the gloss-providing sheet 33 is separated after the temperature of the recording material 16 to which the gloss-providing sheet 33 is adhered is lowered such that the toner is solidified. In the same manner as in the above-mentioned example, it is possible to have a process for automatically separating the gloss-providing sheet 33 from the recording material 16 before the recording material 16 is ejected from the paper ejection outlet 31 using the pair of paper ejection rollers 28. In the same manner, in this case, it is necessary to have a process for waiting until the temperature is lowered before separating the gloss-providing sheet 33.

In the case of this example, when the recording material 16 is passed through the fixing device 40 in the first passing, the image surface of the recording material 16 faces the heating roller 41. However, in the second passing, the recording material 16 is reversed and the image surface faces the pressure roller 42. Accordingly, it is necessary to directly heat the reverse side of the recording material 16 in the second passing through the fixing device by configuring the pressure roller to be capable of functioning as a heating roller, for example.

Also in this example, it is possible to sufficiently fuse the toner at high temperature without generating the problems such as hot offset and winding and to obtain a uniformly smooth high-gloss image in the solid portion, halftone portion, and non-image portion. In particular, this example is greatly effective when a special recording material is used so as to obtain a smooth image surface by disposing a layer coated with thermoplastic resin on a surface thereof and embedding the toner in the coated layer as disclosed in Patent Document 4.

FIG. 4 is another example of a schematic configuration diagram showing an entire portion of an electrophotographic image formation apparatus according to the present invention. This example has substantially the same structure as in the example shown in FIG. 3 and the same reference numerals as in FIG. 3 are assigned to corresponding elements.

In this example, a top stage of the recording material storage cassettes 15 shown in FIG. 3 is disposed as the sheet cassette 34 storing the gloss-providing sheet 33. In other words, the sheet cassette 34 disposed on the opposite side of the process unit 12 relative to the recording material conveying path P in the example of FIG. 3 is disposed on the same side of the process unit 12. And, the gloss-providing sheet 33 fed by the feeding roller 35 is guided to the recording material conveying path P before the pair of register rollers 20 in the same manner.

Further, although the example shown in FIG. 3 includes the unit switching claw 51 for switching between a first position for guiding the recording material 16 fed to the duplex unit 50 to the switchback path 53 and a second position for guiding the recording material 16 after the switchback from the switchback path 53 to the refeed path 54, another unit switching claw 56 is disposed in this example instead of the unit switching claw 51.

The unit switching claw 56 is configured to switch, in the third image formation mode, among the first position for guiding the recording material 16 fed to the conveying path P1 for duplex image formation in the duplex unit 50 to the switchback path 53 as shown in FIG. 5A, the second position for guiding the recording material 16 after the switchback from the switchback path 53 to the refeed path 54 as shown in FIG. 5B in the same manner as in the unit switching claw 51 shown in FIG. 3, and a third position for directly guiding the recording material 16 fed to the duplex unit 50 to the refeed path 54 as shown in FIG. 6.

When the image formation apparatus forms a low-gloss image on a single surface or both surfaces of the recording material 16, the first image formation mode or the third image formation mode is set in the same manner as shown in the example of FIG. 3. However, when the image formation apparatus forms a high-gloss image, through a signal from the host, operation from the operation display panel not shown in the drawings, or the like, the second image formation mode is set and the unit switching claw 56 assumes the third position shown in FIG. 6.

Then, the toner image formed on the photoconductor 13 is transferred to the recording material 16 fed from one of the recording material storage cassettes 15 and the toner is fused once using the fixing device 40 and is fixed. Thereafter, the conveying course of the recording material 16 is switched using the body switching claw 43 and the recording material 16 is conveyed to the duplex unit 50 in the same manner. However, in this example, the recording material 16 fed to the duplex unit 50 is directly guided to the refeed path 54 without switchback operation using the unit switching claw 56, conveyed using the pairs of refeed rollers 55, and returned to the image formation apparatus body 10 without being reversed.

The gloss-providing sheet 33 fed from the sheet cassette 34 is guided to the recording material conveying path P and is placed on the image surface of the recording material 16 returned to the image formation apparatus body 10. Following the pair of register rollers 20, the recording material 16 and the gloss-providing sheet 33 are passed through the transfer nip between the process unit 12 and the transfer device 14 not in operation and are inserted to the fixing device 40 again. Heat and pressure are applied using the heating roller 41 and the pressure roller 42 so as to sufficiently fuse the toner at high temperature again and to adhere the gloss-providing sheet 33 to the recording material 16. Then, the conveying course of the recording material 16 is switched using the body switching claw 43 in the same manner. The recording material 16 is ejected from the paper ejection outlet 31 using the pair of paper ejection rollers 28 and is stacked on the paper ejection stack portion 30.

Thereafter, the gloss-providing sheet 33 is separated after the temperature of the recording material 16 to which the gloss-providing sheet 33 is adhered is lowered such that the toner is solidified. In the same manner as in the above-mentioned examples shown in FIGS. 1 and 3, it is possible to have a process for automatically separating the gloss-providing sheet 33 from the recording material 16 before the recording material 16 is ejected from the paper ejection outlet 31 using the pair of paper ejection rollers 28. In the same manner, it is necessary to have a process for waiting until the temperature is lowered before separating the gloss-providing sheet 33.

Also in this example, it is possible to sufficiently fuse the toner at high temperature without generating the problems such as hot offset and winding and to obtain a uniformly smooth high-gloss image in the solid portion, halftone portion, and non-image portion. In particular, this example is greatly effective when a special recording material is used so as to obtain a smooth image surface by disposing a layer coated with thermoplastic resin on a surface thereof and embedding the toner in the coated layer as disclosed in Patent Document 4.

In addition, according to this example, the unit switching claw 56 for switching the conveying course of the recording material 16 depending on a duplex image formation mode or a high-gloss image formation mode is disposed on the recording material conveying path P included in the duplex unit 50. Thus, by setting the high-gloss image formation mode in which the recording material 16 is passed through the fixing device 40 in the first passing and refeeding of paper is enabled without reversing the recording material 16 after fixing of the toner, it is possible arrange a feeding direction of the gloss-providing sheet 33 and a feeding direction of the recording material 16 in the same direction and to dispose the sheet cassette 34 above the recording material storage cassette 15. In accordance with this, it is possible to densely arrange elements and downsize the image formation apparatus without complicating the structure.

In the example shown in FIG. 3, the image surface of the recording material 16 passed through the fixing device 40 in the first passing is reversed in the second passing, so that the pressure roller must also function as a heating roller, for example. However, according to this example, the image surface is positioned on the same side in the first passing and the second passing, so that only the heating roller 41 is required to function as a heating roller. The structure is simplified also in this arrangement.

The present invention is not limited to the specifically disclosed embodiment, and variations and modifications may be made without departing from the scope of the present invention.

The present application is based on Japanese priority application No. 2006-225119 filed Aug. 22, 2006, Japanese priority application No. 2006-243995 filed Sep. 8, 2006, the entire contents of which are hereby incorporated herein by reference.

What is claimed is:

1. A gloss-providing sheet for providing high gloss to a toner image on a recording material by being placed on a toner image surface of the recording material, heated so as to fuse toner, and then separated from the recording material after the toner is cooled and solidified, the gloss-providing sheet comprising:

a notification portion that changes a visual state thereof when a temperature of the gloss-providing sheet becomes equal to or lower than a glass transition temperature of the toner.

2. The gloss-providing sheet according to claim 1, wherein the notification portion develops color when the temperature of the gloss-providing sheet becomes equal to or lower than the glass transition temperature of the toner.

3. The gloss-providing sheet according to claim 1, wherein the notification portion eliminates color when the temperature of the gloss-providing sheet becomes equal to or lower than the glass transition temperature of the toner.

4. The gloss-providing sheet according to claim 1, wherein the notification portion changes color when the temperature of the gloss-providing sheet becomes equal to or lower than the glass transition temperature of the toner.

5. The gloss-providing sheet according to claim 1, wherein a character string is displayed on the notification portion.

6. The gloss-providing sheet according to claim 1, wherein the notification portion is changed when the temperature of the gloss-providing sheet becomes lower than the glass transition temperature of toner by 20° C. or more.

7. The gloss-providing sheet according to claim 1, wherein the notification portion is constructed using microencapsulated pigment with reversible thermochromic properties.

8. An image formation apparatus for forming a toner image on a recording material, placing a gloss-providing sheet on a toner image surface of the recording material, heating so as to fuse toner to fix the toner image on the recording material, and ejecting the gloss-providing sheet and the recording material, the gloss-providing sheet providing high gloss to the toner image on the recording material by being placed on the toner image surface of the recording material, heated so as to fuse the toner, and then separated from the recording material after the toner is cooled and solidified, wherein the gloss-providing sheet comprises:

a notification portion that changes a visual state thereof when a temperature of the gloss-providing sheet becomes equal to or lower than a glass transition temperature of the toner.

9. An image formation apparatus for allowing a recording material having a toner image on an image surface thereof to pass through a first fixing device so as to fuse toner to fix the toner image on the recording material, and ejecting the recording material, the image formation apparatus comprising:

a sheet cassette for storing a gloss-providing sheet; and a second fixing device fusing the toner again and applying the gloss-providing sheet to the recording material, after the gloss-providing sheet which has been fed from the sheet cassette is placed on the image surface of the recording material having the toner image fixed by the first fixing device, by passing the recording material and the gloss-providing sheet therethrough.

10. The image formation apparatus according to claim 9, wherein the gloss-providing sheet is coated with mold release agent on a surface to be placed on the image surface of the recording material.

11. The image formation apparatus according to claim 9, including:

a first image formation mode for ejecting the recording material only through the first fixing device; and a second image formation mode for ejecting the recording material through both first fixing device and second fixing device.

12. The image formation apparatus according to claim 9, wherein operation of the first fixing device and the second fixing device is performed using a common and single fixing device, the recording material is passed through the common and single fixing device in a first passing, the recording material after the fixing is passed through a conveying path for duplex image formation, the gloss-providing sheet is placed on the recording material, and the recording material and the gloss-providing sheet are passed through the common and single fixing device in a second passing.

13. The image formation apparatus according to claim 12, including:

a switching member for switching a conveying course of the recording material depending on a duplex image formation mode or a high-gloss image formation mode on the conveying path for duplex image formation.

14. The image formation apparatus according to claim 9, wherein the gloss-providing sheet is storable after use in the sheet cassette.

* * * * *